US005758842A

United States Patent [19]

Dorfel et al.

[11] Patent Number: 5,758,842

[45] Date of Patent: Jun. 2, 1998

[54] PAPER WEB WINDER HAVING TWO SUPPORT ROLLS WITH ELASTOMERIC COVERS OF DIFFERENT HARDNESS

[75] Inventors: Gerhard W. Dorfel, Boll, Germany; Rudi F. Deeg, Lee, Mass.

[73] Assignee: Beloit Technologies, Inc., Wilmington, Del.

[21] Appl. No.: 648,141

[22] PCT Filed: Nov. 19, 1994

[86] PCT No.: PCT/EP94/03835

§ 371 Date: Nov. 21, 1996

§ 102(e) Date: Nov. 21, 1996

[87] PCT Pub. No.: WO95/13980

PCT Pub. Date: May 26, 1995

[30] Foreign Application Priority Data

Nov. 19, 1993 [DE] Germany ..... 9317616 U

[51] Int. Cl.[6] ..... B65H 18/14

[52] U.S. Cl. ..... 242/542; 242/541.5; 242/547

[58] Field of Search ..... 242/542, 542.1, 242/542.2, 541.4, 541.5, 547

[56] References Cited

U.S. PATENT DOCUMENTS

| | | | |
|---|---|---|---|
| 2,461,387 | 2/1949 | Medbery . | |
| 3,377,033 | 4/1968 | Link . | |
| 4,128,213 | 12/1978 | Komulainen | 242/542.2 X |
| 4,465,243 | 8/1984 | Welp | 242/541.4 |
| 4,541,585 | 9/1985 | Frye et al. | 242/541.4 X |
| 4,598,877 | 7/1986 | Oinonen | 242/541.5 |
| 4,877,196 | 10/1989 | Heymanns | 242/541.5 |
| 5,335,871 | 8/1994 | Fissmann et al. | 242/542 X |
| 5,431,358 | 7/1995 | Alexander, III | 242/542 |
| 5,464,169 | 11/1995 | Henseler et al. | 242/542 |
| 5,492,287 | 2/1996 | Raudaskoski et al. | 242/542 X |
| 5,553,806 | 9/1996 | Lucas | 242/547 X |
| 5,562,261 | 10/1996 | Beisswanger et al. | 242/542 X |
| 5,582,361 | 12/1996 | Muller et al. | 242/547 X |

FOREIGN PATENT DOCUMENTS

| | | |
|---|---|---|
| 9204667 U | 4/1992 | Germany . |
| 58-42543 | of 1981 | Japan . |

*Primary Examiner*—Donald P. Walsh
*Assistant Examiner*—William A. Rivera
*Attorney, Agent, or Firm*—Dirk J. Veneman; Raymond W. Campbell; Gerald A. Mathews

[57] ABSTRACT

A winding machine for winding webs, such as paper webs which may be longitudinally slit, has two support rollers (TW1 and TW2) that carry the roll being produced (R; R'; R", R"') in a winding bed formed between the support rollers. Both support rollers have elastic casings (M1 and M2) which are however deformable to a different extent. One of the support rollers is partially surrounded by the web during winding. In order to further optimize the winding quality, even in the case of heavy wound web rolls, the support roller (M1) subjected to the highest total load, that results both from static and dynamic loads during winding, has the most elastically deformable casing. Such a winding machine is preferably developed so that the space (DR) delimited by both support rollers (TW1 and TW2) and the already partially produced wound web roll (R) is sealed as much as possible at its ends and from below. An overpressure can be generated in the space (DR) for relieving the inherent weight of the roll (R). This combination of measures substantially prevent undesirable inclusion of air.

5 Claims, 1 Drawing Sheet

Figure 1:
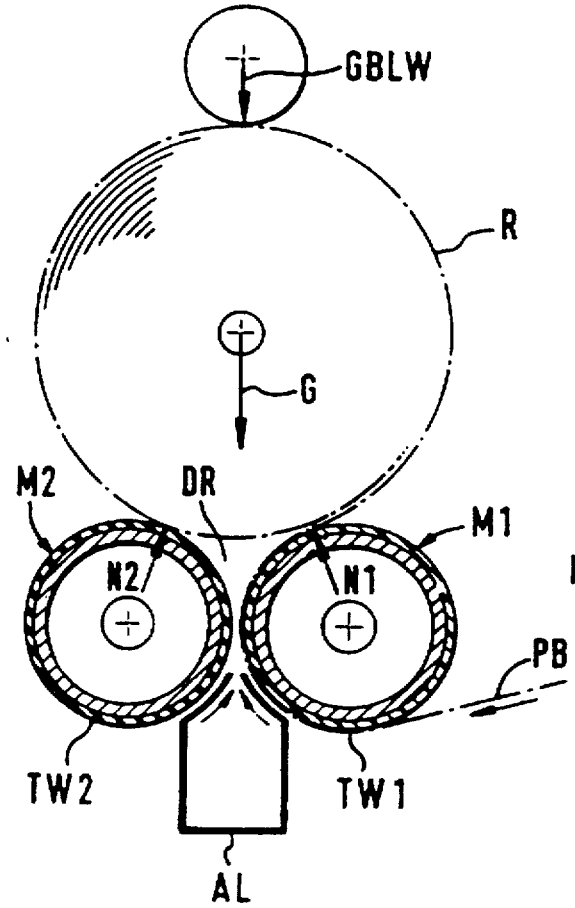

PAPER WEB WINDER HAVING TWO SUPPORT ROLLS WITH ELASTOMERIC COVERS OF DIFFERENT HARDNESS

The invention pertains to a winding machine for winding webs, preferably paper webs, that may be longitudinally slit, wherein the first support roll (TW1), as seen by the web traveling in the machine direction, has a higher total load during the winding process, the total load resulting from both the static and dynamic loads, and has a jacket (M1) which can undergo greater elastic deformation than can the jacket (M2) of the second support roll (TW2).

In order to achieve the most uniform winding result possible, i.e., the most uniform roll structure possible, and to minimize winding flaws as the weight of the roll being produced continues to increase, it is known to provide at least one of the preferably two support rolls with an elastically deformable jacket. The possible combinations are described in DE 92 04 667 U. According to this publication, the best winding results are achieved if the following combination of characteristics is realized in such a support roll arrangement:

- the winding bed is exclusively formed by the two support rolls,
- the second support roll as seen from the machine direction (i.e., the direction in which the paper web is traveling) has a jacket that can deform significantly more than the jacket of the first support roll as seen from the machine direction,
- the second support roll as seen from the machine direction is lowered relative to the first support roll as seen from the machine direction such that a plane extending through the axes of both support rolls forms an angle with the horizontal.

It was determined that this known support roll arrangement rarely provides truly satisfactory winding results.

Consequently, the invention is based on the objective of improving a winding machine of the initially mentioned type in such a way that the roll quality is optimized, even at higher roll weights.

This objective is realized with a winding machine according to the characteristics of partially wrapping the web about the first support roll, as seen coming from the machine direction, and providing the first support roll with a jacket, or cover, which can undergo greater elastomeric deformation than that of the cover of the second support roll.

The invention for the first time recognizes that the dynamic support roll load during the winding process must be taken into consideration when determining the elasticity or rigidity of the support roll surface. It was demonstrated that the total load resulting from both the dynamic and the static load of the support roll, around which the web is partially wrapped, i.e., the first support roll as seen from the machine direction, is always relatively higher than that of the other support roll.

One additional, significant improvement in the winding result can be achieved if the second support roll as seen from the machine direction has a higher coefficient of friction $\mu$ than the corresponding surface of the first support roll as seen from the machine direction within the region of the respective support roll surfaces that contact the web. If this measure is realized in combination having the first support roll, as seen coming from the machine direction, provided with a jacket which can undergo greater elastic deformation, and which first support roll is also partially wrapped by the oncoming web, the tension of the paper web can be optimally adjusted or predetermined on the outer roll surface.

According to one preferred embodiment, the weight load of the second support roll as seen from the machine direction is particularly small in comparison to the weight load of the first support roll as seen from the machine direction.

One additional embodiment of the invention is characterized by the fact that the space limited by the support rolls and the resulting partial roll is charged with a gas pressure via the gap formed between the support rolls such that the inherent weight of the roll is relieved. Naturally, the end surfaces of the space that is charged with the gas pressure must be suitably sealed in order to build up the relief pressure. This so-called air lift has been known for quite some time in two-drum winding machines with relatively inelastic support roll surfaces from U.S. Pat. No. 3,346,209 by the applicant, as well as U.S. Pat. No. 3,497,151, DE-C-1 047 001, DE-C-1 111 496 and DE-U-92 01 791, among others.

In these known air lift devices for two-drum winding machines, it is of particular importance to obtain the most uniform gap possible between the surface of the already wound roll and the support roll around which the web is wrapped. Otherwise, the pressure relief fluid would be entrained by the web to be wound and enclosed between said web and the wound roll.

The invention has recognized that this gap can only be realized uniformly if the web to be wound is sufficiently porous for allowing the entrained compressed air to penetrate. In most instances, irregularities in the surface of the wound roll along the line of contact with the support roll around which the web is wrapped have very negative effects on the quantity of the entrained pressure relief air. In the combination according to the invention, the elasticity of the jacket of the support roll around which the web is wrapped causes the support roll surface to adapt itself to the corrugations of the roll along the line of contact with the already wound roll. This measure minimizes possible air admission gaps between the web and the wound roll, i.e., the entrained air is reduced to an acceptable degree (quantity). It goes without saying that the combination of an air lift and an elastic jacket of the support roll around which the web is wrapped can also be very advantageously utilized if the (second) support roll around which the web is not wrapped has a hard jacket instead of an elastic jacket.

The aforementioned structural components to be utilized in accordance with the invention are not subject to any particular exceptions with respect to their size, shape, material selection and technical concept, so that the selection criteria known in the respective field of application can be utilized in unrestricted fashion.

Additional details, characteristics and advantages of the object of the invention are disclosed in the following description of the figures that show an—exemplary—embodiment of the device according to the invention.

Figure 2:
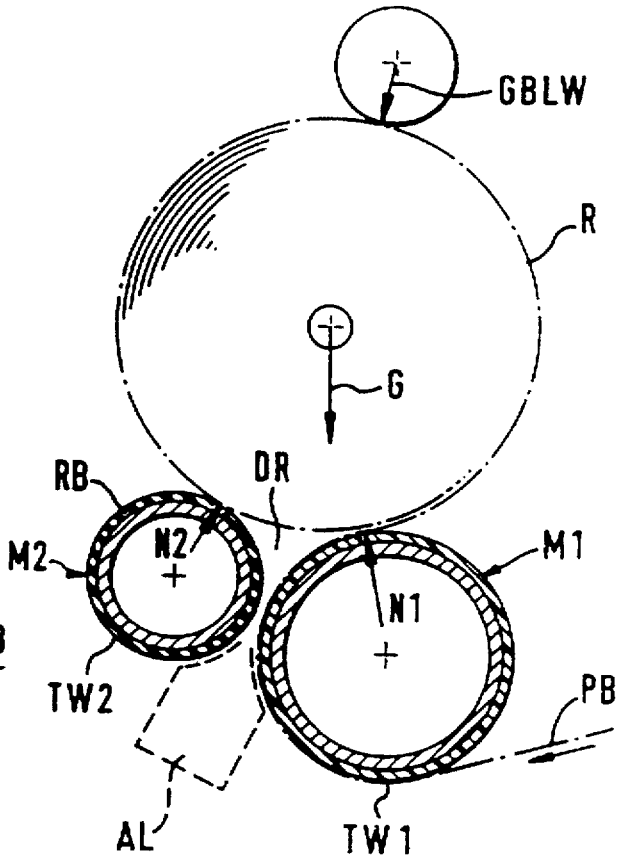

The figures show:

FIG. 1, a schematic end surface view of the winding machine according to the invention;

FIG. 2, an end surface view of another embodiment of the winding machine, and

Figure 3:
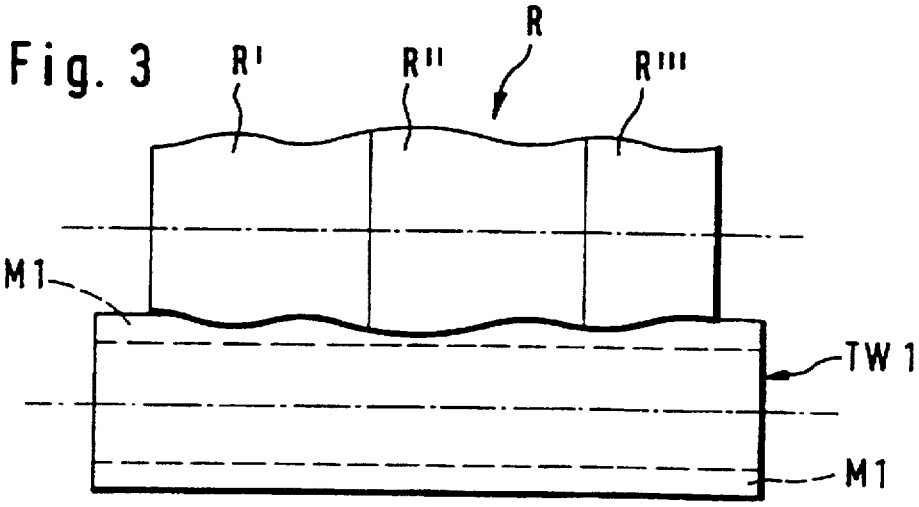

FIG. 3, a side view of a support roll according to the invention with a partially wound roll (all figures are illustrated in highly schematic fashion).

In the embodiment according to FIG. 1, two driven support rolls TW1 and TW2 of identical diameter are provided. Each support roll is provided with an elastically deformable jacket M1, M2, with the jacket M1 forming the relatively "softer" coating and the jacket M2 forming the relatively "harder" coating. The paper web PB is wrapped around the first support roll TW1 by an angle of approximately 180° and wound into the roll R that has the weight G. When starting each winding process, the weight load exerted upon the two support rolls can be artificially increased (GBLW) in conventional fashion by means of a load roller. The normal load N1 and N2 exerted upon the two support rolls by the weight of the roll is identical in this embodiment. However, the dynamic load and consequently the total load of the support roll TW1, around which the web is wrapped, is higher than that of the support roll TW2.

The housing of a generally known air lift, which is identified by the reference symbol AL, is inserted into the lower gap region between the two support rolls from the bottom such that the edges are sealed. Compressed air, which is fed to the air lift housing in a way that is not illustrated in the figure, is able to flow through the axially parallel outlet gap into the space that is situated on top of the gap between the two support rolls and sealed on top by the roll R in the form of weight relief air, with the end surfaces of said pressure relief space DR being sealed in conventional fashion.

The embodiment according to FIG. 2 differs from the embodiment according to FIG. 1 in that, among other things, the diameter of the support roll TW1 around which the web is wrapped is greater than the diameter of the support roll TW2, and that the axis of the latter is higher than the axis of the first support roll, with the load roller becoming effective at an angle to the vertical. Due to this arrangement, the normal load N1 of the support roll TW1 is noticeably higher than the normal load N2 of the support roll TW2. In this particularly preferred embodiment, the surface of the support roll TW2, around which the web is not wrapped, is provided with a coating RB that increases its coefficient of friction. An air lift is optional in this embodiment and is consequently illustrated by broken linings.

FIG. 3 shows how the elastically deformable jacket M1 of the support roll TW1 adapts itself to the highly exaggerated corrugations of the wound roll R such that air inclusion gaps are therefore minimized or suppressed.

We claim:

1. In a machine for winding a paper web, the web traveling in a machine direction, into a wound web roll, the machine including a gapped pair of support rolls in the first and second positions, each support roll having an axis of rotation and a jacket which is elastically deformable, the support rolls rotatably supporting the web roll being wound, the improvement comprising:

the jackets on each support roll having different degrees of elastic deformation, such that their amounts of deformation in supporting the web roll being wound are different;

the jacket on the support roll in the second position has a coefficient of friction greater than the coefficient of friction on the jacket on the support roll in the first position, both positions as seen from the machine direction.

2. The machine for winding a traveling paper web, as set forth in claim 1, further including:

means, including an airlift housing, for operably applying compressed air to the gap between the surfaces of the two support rolls, and the web roll being wound, such that an air overpressure can be applied to the gap, whereby the web roll being wound is partially supported by the air overpressure.

3. The machine for winding a traveling paper web, as set forth in claim 1, wherein:

the jacket on the support roll in the first position, relative to the machine direction, is softer, or more elastically deformable, than the jacket on the support roll in the second position, relative to the machine direction.

4. The machine for winding a traveling paper web, as set forth in claim 1, further including:

a load roller in nipping engagement with the web roll being wound, the load roller applying an overload to the web roll being wound in a plane through the load roller nip with the web roll being wound and its axis of rotation, which plane is substantially perpendicular with a plane containing the axes of rotation of the pair of support rolls.

5. The machine for winding a traveling paper web, as set forth in claim 1, wherein:

the diameters of each of the support rolls are different, with the diameter of the first support roll, relative to the machine direction, being larger than the diameter of the second support roll;

the traveling paper web is directed over the first support roll, beginning at a location about the lower periphery thereof to partially wrap the first support roll;

whereby the total load resulting from the static and dynamic load on the first support roll is higher than the total load on the second support roll.

* * * * *